US005711560A

United States Patent [19]

Gilbertson

[11] Patent Number: 5,711,560

[45] Date of Patent: Jan. 27, 1998

[54] DOOR SECURITY WEDGE

[76] Inventor: Einar Gilbertson, 7239 Upton Ave. South, Richfield, Minn. 55423

[21] Appl. No.: 684,288

[22] Filed: Jul. 18, 1996

[51] Int. Cl.[6] ..... E05C 17/54

[52] U.S. Cl. ..... 292/343

[58] Field of Search ..... 292/343, 342, 292/DIG. 15, 339

[56] References Cited

U.S. PATENT DOCUMENTS

| | | | |
|---|---|---|---|
| 177,102 | 5/1876 | Daniels . | |
| D. 284,738 | 7/1986 | Stone | D8/402 |
| 550,267 | 11/1895 | Flesch . | |
| 929,287 | 7/1909 | Collins . | |
| 932,694 | 8/1909 | Fulton . | |
| 1,119,650 | 12/1914 | Smith | 292/343 |
| 1,351,453 | 8/1920 | Wells, Jr. | 292/343 |
| 2,459,070 | 1/1949 | Gard | 292/343 |
| 3,328,065 | 6/1967 | Arenson | 292/343 |
| 4,230,353 | 10/1980 | Bjorgum | 292/343 |
| 4,881,293 | 11/1989 | Reynolds | 16/86 |
| 4,890,092 | 12/1989 | Grimm | 292/339 X |
| 5,011,203 | 4/1991 | Tackett | 292/343 |
| 5,056,836 | 10/1991 | Wells | 292/288 |
| 5,217,269 | 6/1993 | Wiltberger | 292/343 |
| 5,340,173 | 8/1994 | Bethel | 292/343 X |
| 5,340,175 | 8/1994 | Wood | 292/339 |
| 5,368,349 | 11/1994 | Hebert et al. | 292/343 |

FOREIGN PATENT DOCUMENTS

| | | | |
|---|---|---|---|
| 602172 | 7/1933 | France | 292/343 |
| 333282 | 2/1921 | Germany | 292/343 |
| 278392 | 7/1934 | Italy | 292/343 |
| 2212213 | 7/1989 | United Kingdom | 292/342 |

*Primary Examiner*—Rodney M. Lindsey
*Attorney, Agent, or Firm*—Westman, Champlin & Kelly, P.A.

[57] ABSTRACT

A security wedge for use in connection with retaining a door in a position to prevent opening including a wedge member that has a plurality of retainer projections positioned on a bottom surface thereof. The projections are insertable into carpeting after the wedge has been placed under the door with the door closed so the wedge is prevented from slipping and the door cannot be opened unless it is broken down. A rubber cap can be placed on the bottom of the wedge for use on hard surface floors.

8 Claims, 3 Drawing Sheets

DOOR SECURITY WEDGE

BACKGROUND OF THE INVENTION

The present invention relates to a door security wedge, which provides a positive, locked in place mechanical stop to prevent opening of a door that swings over carpeting or softer floor covering.

Security in hotel rooms has become an issue in recent years, and the ability to break through dead bolts and other locks that are normally provided on a hotel room is widespread. The traveler that needs to be secure for any reason requires a simple, small, compact, and reliable stop for insuring that the door to the room will not be capable of being opened unless it is completely destroyed.

The present invention answers that need by providing a compact, simply operated stop, that will, in connection with carpeting, insure that the door cannot be swung open unless it is broken off its hinges.

SUMMARY OF THE INVENTION

The present invention relates to a security wedge member that can be inserted under a door and which, when secured on carpeting or other soft penetrateable covering, or when used with a non-skid support for bare floors, insures that the door cannot be opened because the wedge is positively held in place. The stop has suitable grip projections that engage carpeting surface adjacent the door and in the swing space when used for carpeted rooms. A non-skid material cap can be placed over the projection for engaging a hard surface if no carpet is present. The security wedge of the present invention is preferably made of a tough, hard plastic having a wedge angle that is selected to insure that the door will be positively held once the door has been closed and the wedge is in place under the door.

The wedge has a side wall and is generally hollow with reinforcing interior braces. A plurality of pins or spikes are molded and extend downwardly from the edges of the walls. The pins or spikes form grip members and are positioned so they can be embedded into the carpeting and are graduated in length with the shortest spikes near the narrow end. The narrow end of the wedge is slid under the door between the carpeting and the bottom edge of the door. Then the pins or spikes which are near the high end of the wedge are put into the penetrateable surface so that the door cannot be opened. The security wedge will not slip out of the floor covering in that the door forces the spikes farther into the floor covering. When the non-skid cap is put into place the unit operates much like a standard door stop. The non-skid cap has sockets for the pins and a high friction bottom surface that engages hard surface floors, such as wood or concrete.

The security wedge is compact, will fit into a purse or carry on baggage, is easy to use and needs no assembly or attachments. The security wedge can be used in a wide variety of locations for insuring that a door that is to be secured cannot be opened unintentionally.

The use of the wedge also permits the occupant of a room to view anyone at the door before removing the wedge.

The use of present wedge eliminates worries that can arise from other people having keys to a motel or hotel room. The unit is a personal security system that is easily carryable.

DETAILED DESCRIPTION OF THE PREFERRED EMBODIMENTS

Figure 1:
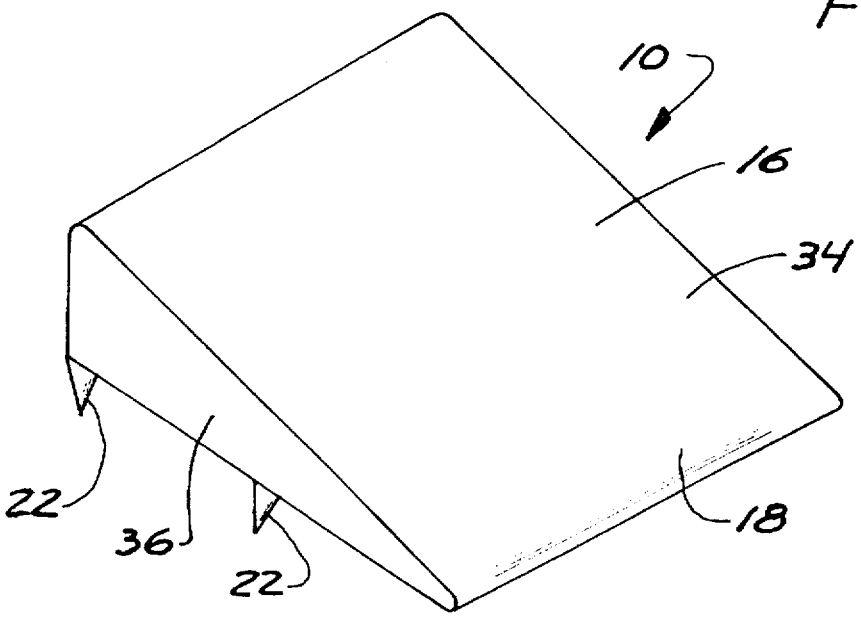
FIG. 1 is a perspective view of a security wedge made according to the present invention shown in a first form of use.
Figure 2:
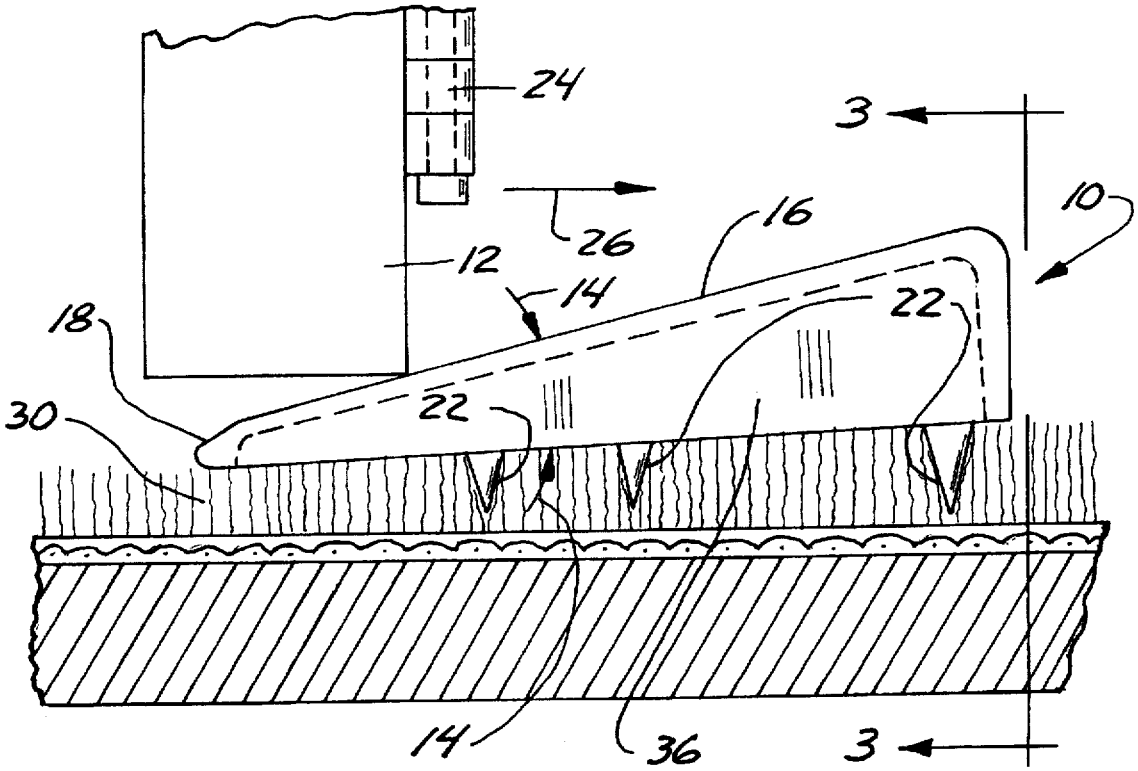
FIG. 2 is a view of the security wedge of FIG. 1 showing the wedge in position under a door.
Figure 3:
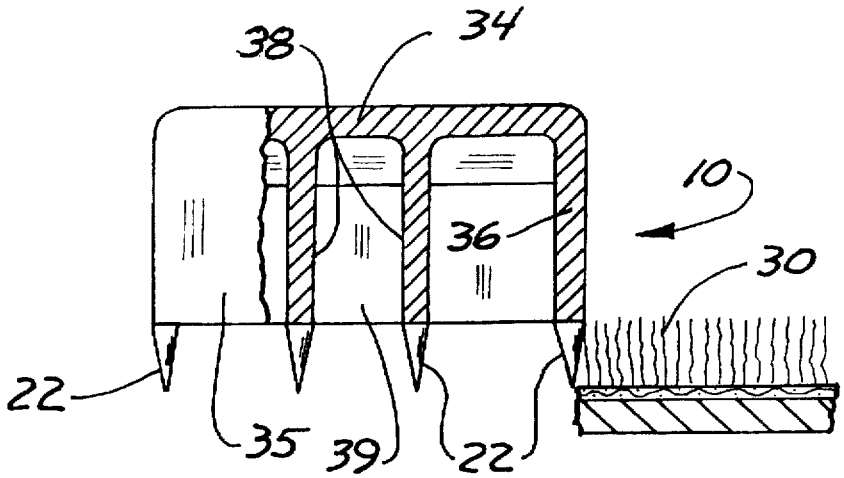
FIG. 3 is a view taken as on line 3—3 in FIG. 2.

A security door retaining wedge member indicated generally at 10 is a security type wedge that can be used for preventing opening of a door 12. The door is hinged on a frame in the usual manner and has a sweep space over the floor covering as the door opens. As shown, the wedge has a relatively gentle angle indicated by the double arrows 14 in FIG. 2, and a smooth upper surface 16 that will permit sliding the wedge narrow leading end indicated at 18 under a bottom surface 20 of the door 12.

The underside of the wedge member 10 is provided with a plurality of spaced apart tapered pins or spikes or grip projections 22 that are molded in place, preferably.

Figure 4:
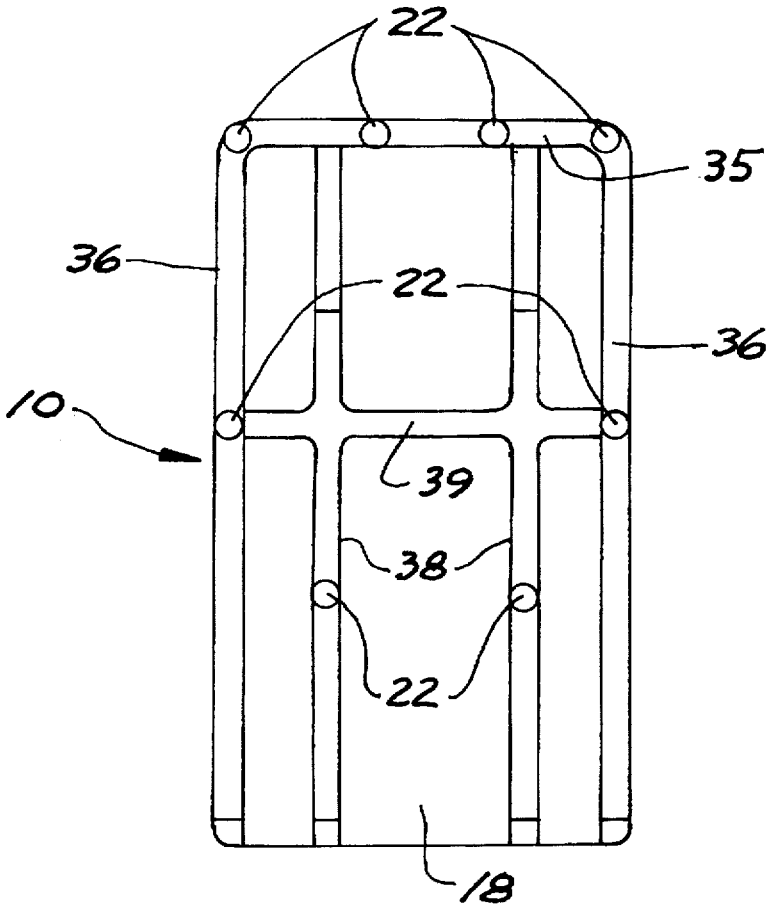
FIG. 4 is a bottom plan view of the security wedge of FIG. 1.

The wedge, as shown in FIG. 4, has a top wall 34, a base wall 35 and side walls 36. A pair of longitudinal brace walls 38 and a cross base wall 39 form internal supports. The spikes or pins 22 extend from the bottom edges of the walls in selected locations. The bottom edges of the base walls, side walls and brace wall form a support plane.

The wedge can be formed in other ways. For example, if the wedge is made of wood instead of the preferred plastic, the spikes can be inserted into the wood and epoxied or threaded in place.

The door 12 is supported on suitable hinges 24, and will swing inwardly in a direction as indicated by the arrow 26 for opening. The wedge is used by tipping up the base end so that the spikes or grip projections 22 clear the carpeting or other suitable floor covering shown at 30. Carpeting is standard in most rooms and is provided across the threshold of the door. It should be noted that in most rooms there is a clearance space between the bottom surface 20 of the door and the top of the carpet 30. The wedge can be used in this form by slipping the narrow end or forward portion 18 under the door surface 20, until the wedge end 18 is relatively well situated and snug under the door and then moving the wedge base downwardly in the direction as indicated by the arrow 32. This will force the security spikes or grip projections 22 into the floor. The spikes 22 will embed sufficiently so that it will be essentially impossible to move the wedge without breaking down the door or destroying the hinges 24. The door also forces the spikes 22 into the floor covering as the door is moved because of the wedge angle.

The wedge is relatively small, having a length in the range of 4 inches (preferably 3.5 to 4.5 inches), and a width of about 2 inches, so that it can be easily kept in a pouch and carried in the traveler's carry-on baggage or in a purse. The leading end is about 0.125 inches high or less, and the rear or base wall is about 1.125 inches high to provide a shallow wedge angle of about 15°. About the front one third of the bottom of the wedge is free of pins or spikes to make insertion under the door easier. The pins or spikes are graduated in length, as shown, with the longer spikes near the base end.

In situations where there is no carpeting in the room, and a hard surface floor, such as wood or concrete is provided, the wedge shown in FIGS. 1–4 can be provided with a cap that is made of high friction material and will provide a door stop of the normal function on a hard surface.

Figure 5:
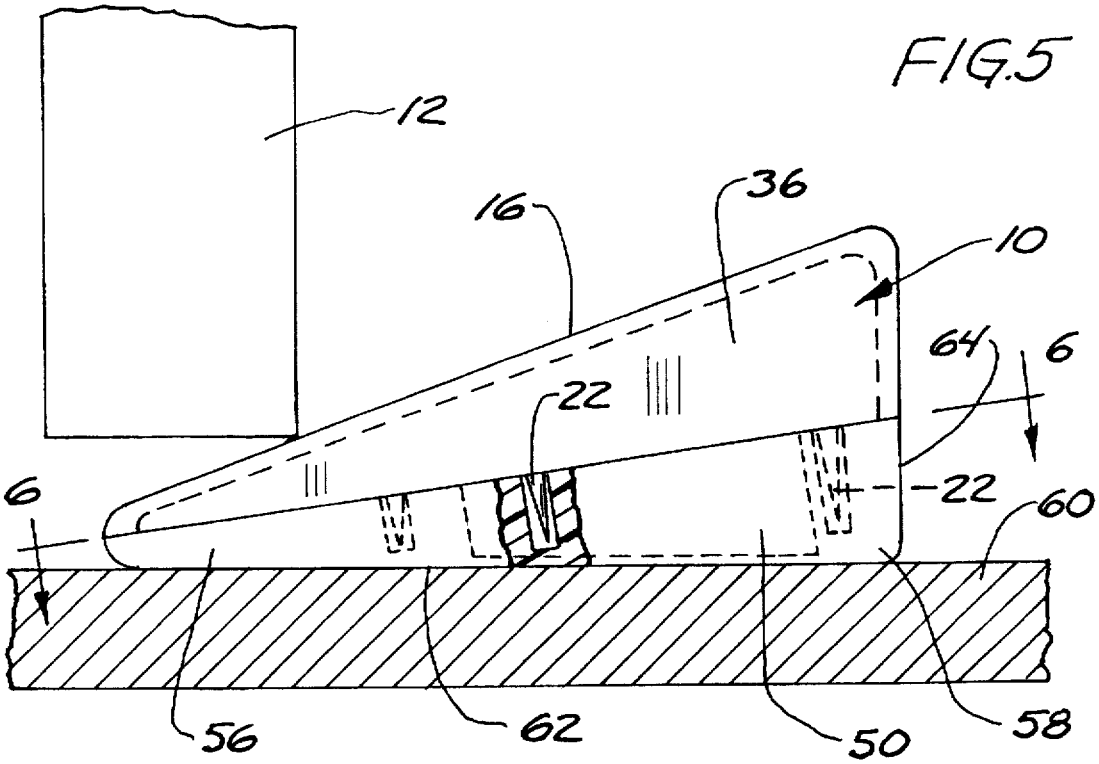
FIG. 5 is a side view of the security wedge of FIG. 1 shown with a high friction cap to adapt the wedge for use on hard surface floors.

As shown in FIG. 5, wedge member 10 as constructed as shown in the first form of the invention, although if desired it may have a different wedge angle, and may be slightly less in vertical height when adapted for use with a non-skid cap. The wedge member 10 has the protruding spikes or prongs 22, and in this form, a high friction or substantially non-skid cap 50 is provided to rest against the support plane of the wedge 10. The cap 50 is made of a suitable rubber or polymeric material, and is molded.

Figure 6:
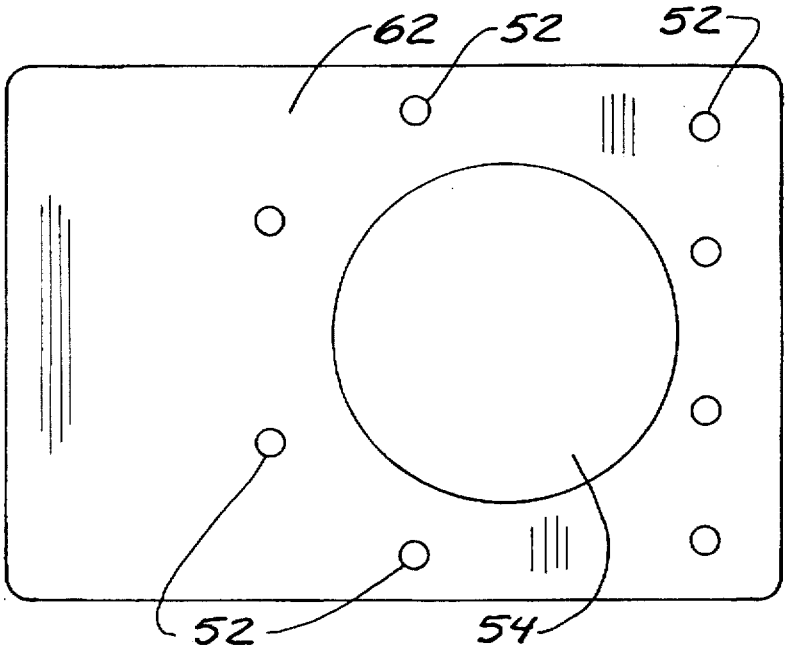
FIG. 6 is a view taken on line 6—6 in FIG. 5.

As can be seen in FIG. 6, the cap is a unitary member having a plurality of receptacles 52 that are of size and of depth to receive the different lengths of the prongs or spikes 22. The receptacles can be of a diameter so they will grip on the spikes to hold the cap on the wedge. The receptacles are deep enough so the spikes do not bottom out. The pattern of the receptacles 52 matches the positioning of the spikes on the wedge member 10.

Figure 7:
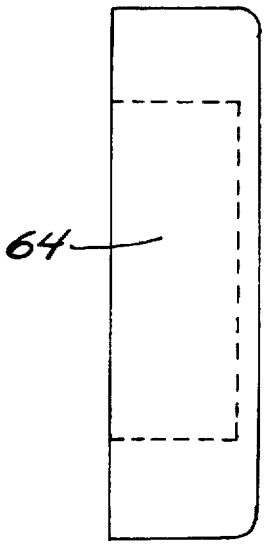
FIG. 7 is an end view of FIG. 6.

A recess 54 can be provided in the center portion for reducing weight and reducing material needed. The cap 50, as shown, also is tapered from a leading or narrow end 56 to a base end 58. The number of the receptacles or openings 52 can be varied as desired for the size of the wedge, and it can be seen that the wedge cap can be placed against the bottom side of the wedge 10 (on the support plane), and then slid under a door 12 onto a hard surface floor 60. In this manner, the assembly is convertible from a unit that is usable carpeting, using just the spikes as shown in FIGS. 1–4 or to a unit that is usable with hard surface floors utilizing a substantially non-skid material cap that receives the spikes, forms a friction surface 62 that will ride on the surface of a hard surface floor 60. The rear wall of the cap 22 is shown at 64 in FIG. 7, and as can be seen the surfaces of the cap taper from the rear wall to the leading or narrow end 56. The surface 62 may be roughened slightly if desired, or may have an additional layer of high friction material added thereto to insure that it will not slide on a hard surface.

Preferably the cap is made of a rubber selected to have a good grip on a hard smooth surface, and is in the durometer range of 40 to 70 Shore A hardness. A natural rubber blend has been preferred.

The cap and wedge can easily be carried and used very efficiently by merely placing the cap in a position where the spikes or prongs are extended into openings in the surface of the cap. The cap forms a wedge angle that is a little steeper than in the first form of the invention alone, but is still adequate to serve as a door stop.

The unit is simple, easy to use, and is effective in providing security for a user.

Although the present invention has been described with reference to preferred embodiments, workers skilled in the art will recognize that changes may be made in form and detail without departing from the spirit and scope of the invention.

What is claimed is:

1. A wedge including a main body molded unitarily from a plastic and having an upper wall having an inclined upper surface extending along a longitudinal length from a lower end portion to a raised portion having a height at a base end, the height of said base end being selected to exceed a selected spacing between a door and floor covering over which the door moves and the lower end portion having a height less than the selected spacing, the wedge having a base wall at the base end, a pair of spaced side walls extending longitudinally from the lower end portion to the base end and forming a hollow interior with the base wall, at least one longitudinally extending brace wall positioned between the side walls to support the upper wall in the hollow interior, and a cross wall extending between and molded to the side walls, and brace wall, downwardly facing edges of the base wall, brace wall, and cross wall lying on a support plane;

and a plurality of grip retainers extending downwardly from the downwardly facing edge of the base wall and a separate grip retainer extending from each of the edges of the side walls and the brace wall, said grip retainers being of a size to engage a floor covering surface to retain the wedge from moving in a longitudinal direction.

2. The wedge of claim 1, wherein the grip retainers comprise sharp end spikes molded in place.

3. The wedge of claim 2, wherein there are a plurality of brace walls molded to the top wall, and the cross wall being molded to each brace wall and the side walls, the side walls having spikes extending from the edges thereof at a location between the base wall and the cross wall and of a length shorter than the spikes on the base wall and the brace walls having spikes on the edges thereof between the cross wall and the lower end portion, the spikes on the brace walls being shorter than the spikes on the side walls.

4. The wedge of claim 2, wherein the spikes are graduated in length, with the longest spike being mounted on the edge of the base wall, and shorter spikes being mounted on said side walls and brace walls spaced from the base wall toward the lower end portion.

5. The wedge of claim 1, wherein the inclined upper surface of the wedge has an included angle of in the range of 15°.

6. The wedge of claim 1 and a cap made of selected material having a coefficient of friction resisting sliding on hard surfaces, the cap having a plurality of receptacles on one side for receiving the grip retainers and an opposite side providing a support surface for the wedge.

7. The wedge of claim 6, wherein said cap is made of a rubber material having a durometer of 40 to 70 Shore A.

8. The wedge of claim 1, wherein the lower end portion is about 0.125 inch high, and the base end is in the range of 1.125 inches high, said wedge having a longitudinal length along a longitudinal plane in the range of 3.5 to 4.5 inches.

* * * * *